US008585464B2

(12) United States Patent
Chilson

(10) Patent No.: US 8,585,464 B2
(45) Date of Patent: Nov. 19, 2013

(54) LAPPING SYSTEM AND METHOD FOR LAPPING A VALVE FACE

(75) Inventor: Rick J. Chilson, Belmont, NY (US)

(73) Assignee: Dresser-Rand Company, Olean, NY (US)

( * ) Notice: Subject to any disclaimer, the term of this patent is extended or adjusted under 35 U.S.C. 154(b) by 932 days.

(21) Appl. No.: 12/620,303

(22) Filed: Nov. 17, 2009

(65) Prior Publication Data

US 2011/0081831 A1 Apr. 7, 2011

Related U.S. Application Data

(60) Provisional application No. 61/249,499, filed on Oct. 7, 2009.

(51) Int. Cl.
*B24B 1/00* (2006.01)
*B23C 3/05* (2006.01)

(52) U.S. Cl.
USPC ..... 451/51; 137/243; 451/61; 451/115; 451/359; 451/430; 451/440; 451/519; 451/525

(58) Field of Classification Search
USPC ..... 137/243, 243.1, 243.2, 243.3, 243.6, 137/243.7; 408/79, 80, 82, 83.5; 451/51, 451/61, 115, 116, 117, 118, 252, 359, 360, 451/430, 431, 440, 519, 523, 524, 525, 541, 451/542, 543, 550
See application file for complete search history.

(56) References Cited

U.S. PATENT DOCUMENTS 1,404,103 A * 1/1922 Eckenroth ..... 137/243.2
1,596,047 A * 8/1926 Kelly ..... 137/243.2
1,640,040 A * 8/1927 Kelly ..... 137/243.2
1,696,525 A 12/1928 Collidge
1,701,329 A * 2/1929 McIntosh ..... 408/83.5
1,939,767 A * 12/1933 Corvin ..... 408/83.5
2,203,142 A * 6/1940 Haas ..... 451/430
2,258,505 A * 10/1941 Densmore ..... 451/430
2,292,383 A * 8/1942 Liebmann ..... 408/83.5
2,265,373 A 12/1947 Johnson (Continued)

FOREIGN PATENT DOCUMENTS

DE C-866 386 2/1953
EP 0556380 8/1993

(Continued)

OTHER PUBLICATIONS

PCT/US2011/045831—International Search Report and Written Opinion mailed Feb. 9, 2012.

(Continued)

*Primary Examiner* — Timothy V Eley

(74) *Attorney, Agent, or Firm* — Edmonds & Nolte, PC

(57) ABSTRACT

A lapping system includes a shaft. A stabilizing member is coupled to the shaft. A lapping tool is coupled to the shaft and spaced apart on the shaft from the stabilizing member. An adjustable force device is coupled to the shaft, the stabilizing member, and the lapping tool. The adjustable force device is operable to be adjusted in order to cause the stabilizing member to support at least some of the weight of the lapping tool. The lapping system may be coupled to a valve body having a valve face to ensure alignment of the lapping tool and the valve face while providing a controlled, vertical force from the lapping tool to the valve face.

19 Claims, 5 Drawing Sheets

(56) References Cited

U.S. PATENT DOCUMENTS

| | | | | | |
|---|---|---|---|---|---|
| 2,460,985 | A | * | 2/1949 | Wellman | 408/83.5 |
| 2,538,311 | A | | 1/1951 | Hawks, Jr. | |
| 2,611,223 | A | | 9/1952 | Emge | |
| 2,624,944 | A | | 1/1953 | Pujda | |
| 2,677,309 | A | * | 5/1954 | Koons | 408/83.5 |
| 2,704,911 | A | | 3/1955 | Nylund | |
| 2,717,453 | A | | 9/1955 | Wildt | |
| 2,737,726 | A | | 3/1956 | Christiansen | |
| 2,769,287 | A | * | 11/1956 | Arp | 451/430 |
| 2,809,482 | A | * | 10/1957 | Soulet | 451/430 |
| 2,908,120 | A | | 10/1959 | Jensen | |
| 2,965,970 | A | | 12/1960 | Rocheleau | |
| 3,110,137 | A | * | 11/1963 | Gross | 451/512 |
| 3,377,713 | A | | 4/1968 | Schiler | |
| 3,380,170 | A | | 4/1968 | Read | |
| 3,546,781 | A | | 12/1970 | Cox | |
| 3,946,526 | A | * | 3/1976 | Reutter | 451/430 |
| 4,266,345 | A | | 5/1981 | Alice | |
| 4,338,961 | A | * | 7/1982 | Karpenko | 137/243.2 |
| 4,465,091 | A | * | 8/1984 | Keller | 137/243.6 |
| 4,467,566 | A | * | 8/1984 | Ondrus et al. | 451/430 |
| 4,478,553 | A | | 10/1984 | Leibowitz | |
| 4,536,962 | A | | 8/1985 | Hense | |
| 4,598,480 | A | | 7/1986 | Cukelj | |
| 4,627,461 | A | * | 12/1986 | Gordon | 137/243.1 |
| 4,653,011 | A | | 3/1987 | Iwano | |
| 4,896,515 | A | | 1/1990 | Endou | |
| 5,109,564 | A | * | 5/1992 | Horvath | 15/236.06 |
| 5,152,070 | A | | 10/1992 | Sorokes | |
| 5,282,726 | A | | 2/1994 | Warren | |
| 5,289,847 | A | | 3/1994 | O'Leary | |
| 5,529,091 | A | | 6/1996 | Anderson | |
| 5,727,930 | A | | 3/1998 | Bennitt | |
| 5,882,250 | A | * | 3/1999 | Foster | 451/430 |
| 6,004,118 | A | | 12/1999 | Templar | |
| 6,042,456 | A | * | 3/2000 | Foster | 451/51 |
| 6,382,158 | B1 | | 5/2002 | Durnen | |
| 6,530,234 | B1 | | 3/2003 | Dobak | |
| 7,343,890 | B1 | | 3/2008 | Platt | |
| 7,347,187 | B2 | | 3/2008 | Perini | |
| 7,413,399 | B2 | | 8/2008 | Trewin | |
| 7,647,790 | B2 | | 1/2010 | Ignatiev | |
| 7,921,870 | B2 | * | 4/2011 | Hardie et al. | 137/243.3 |
| 2005/0044865 | A1 | | 3/2005 | Manole | |
| 2011/0081831 | A1 | | 4/2011 | Chilson | |

FOREIGN PATENT DOCUMENTS

| | | |
|---|---|---|
| GB | 191107446 | 0/1911 |
| GB | 2474348 | 4/2011 |
| JP | 3030568 | 9/1994 |
| JP | 2000-146326 | 5/2000 |
| JP | 2002-188865 | 7/2002 |
| JP | 2006239836 | 9/2006 |
| JP | 2007-255748 | 10/2007 |
| WO | WO9305357 | 3/1993 |
| WO | WO2012027063 | 3/2012 |

OTHER PUBLICATIONS

Texas Institute of Science, Department of Power System Engineering, "Feasibility Study CO2 Compression Power Reduction" Preliminary Report for Dresser-Rand Project 989-001-002; Aug. 2009; 47 pages.

Jiri Polansky Peir Milcak, Kamil Sedlak, Vaclav Uruba, Jiri Linhart, Radim Mares, Lukas Choulik, Dalibor Dvorak and Pavel Zitek, Texas Institute of Science, Department of Power Systems Engineering, Faculty of Mechanical Engineering, University of West Bohemia, Project 989-001-002; Feasibility Study CO2 Compression Power Reduction, Sep. 2009; 83 pages.

Shruti Deshwal, E. Bikram Raj Kumar, Geiper Consulting PVT. LTD., "Patentability Search Report" Apr. 5, 2010, Noida, India; 29 pages.

EP92920137 Supplementary European Search Report dated May 13, 1994.

PCT/US1992/007617—Notification of International Search Report mailed Nov. 10, 1992.

PCT/US2011/045831—International Preliminary Report on Patentability dated Feb. 15, 2013.

* cited by examiner

LAPPING SYSTEM AND METHOD FOR LAPPING A VALVE FACE

CROSS-REFERENCE TO RELATED APPLICATION

This application claims the benefit of the filing date of U.S. Patent Application Ser. No. 61/249,499, filed on Oct. 7, 2009, the entire disclosure of which is incorporated herein by reference.

BACKGROUND

This disclosure relates in general to valve assemblies, and in particular to a lapping system for use with a valve assembly.

Some valve assemblies include a valve body and an internal valve stem that is seated on a valve face of the valve body during valve operation. It is desirable for a tight seal to exist between the internal valve stem and the valve face on which it sits such that no leaks are allowed between the internal valve stem and the valve face. Traditionally, a lapping process is performed on the valve face in which a lapping tool is positioned adjacent the valve face with a lapping compound between the lapping tool and the valve face. The lapping tool is then moved relative to the valve face, causing the lapping material to smooth the valve face such that a tight seal may be provided between the internal valve stem and the valve face. However, conventional lapping tools suffer from a number of issues. For example, the lapping tool may become misaligned with the valve face during lapping, creating a surface on the valve face that is uneven and cannot form a tight seal. It is also difficult to control the pressure applied to the valve face using these conventional lapping tools, which can also create a surface on the valve face that is uneven and cannot form a tight seal. Furthermore, with conventional lapping tools that perform the lapping operation by rotating relative to the valve face through the twisting of an arm that extends from the lapping tool, unwanted horizontal forces can be imparted by the lapping tool that can also create a surface on the valve face that is uneven and cannot form a tight seal.

Therefore, what is needed is an improved lapping system.

SUMMARY

Embodiments of the disclosure may provide a lapping system including a shaft, a stabilizing member coupled to the shaft, a lapping tool coupled to the shaft and spaced apart on the shaft from the stabilizing member, and an adjustable force device coupled to the shaft, the stabilizing member, and the lapping tool, wherein the adjustable force device is operable to be adjusted in order to cause the stabilizing member to support at least some of the weight of the lapping tool.

Embodiments of the disclosure may provide a valve face lapping system including a valve body comprising a valve face and defining an opening, and a lapping system coupled to the valve body, the lapping system comprising: a shaft, a stabilizing member coupled to the shaft and seating in the opening, a lapping tool coupled to the shaft and spaced apart on the shaft from the stabilizing member, wherein the lapping tool is located immediately adjacent the valve face, and an adjustable force device coupled to the shaft, the stabilizing member, and the lapping tool, wherein the adjustable force device is operable to adjust the force imparted by the lapping tool on the valve face.

Embodiments of the disclosure may provide a method for lapping a valve face including providing a lapping system comprising a lapping tool coupled to a stabilizing member through a shaft, and an adjustable force device coupled to the shaft and the lapping tool, coupling the lapping system to a valve body, wherein the lapping tool is located adjacent a valve face on the valve body and the stabilizing member is seating in an opening defined by the valve body, adjusting the force imparted by the lapping tool on the valve face using the adjustable force device, and rotating the shaft to move the lapping tool relative to the valve face.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
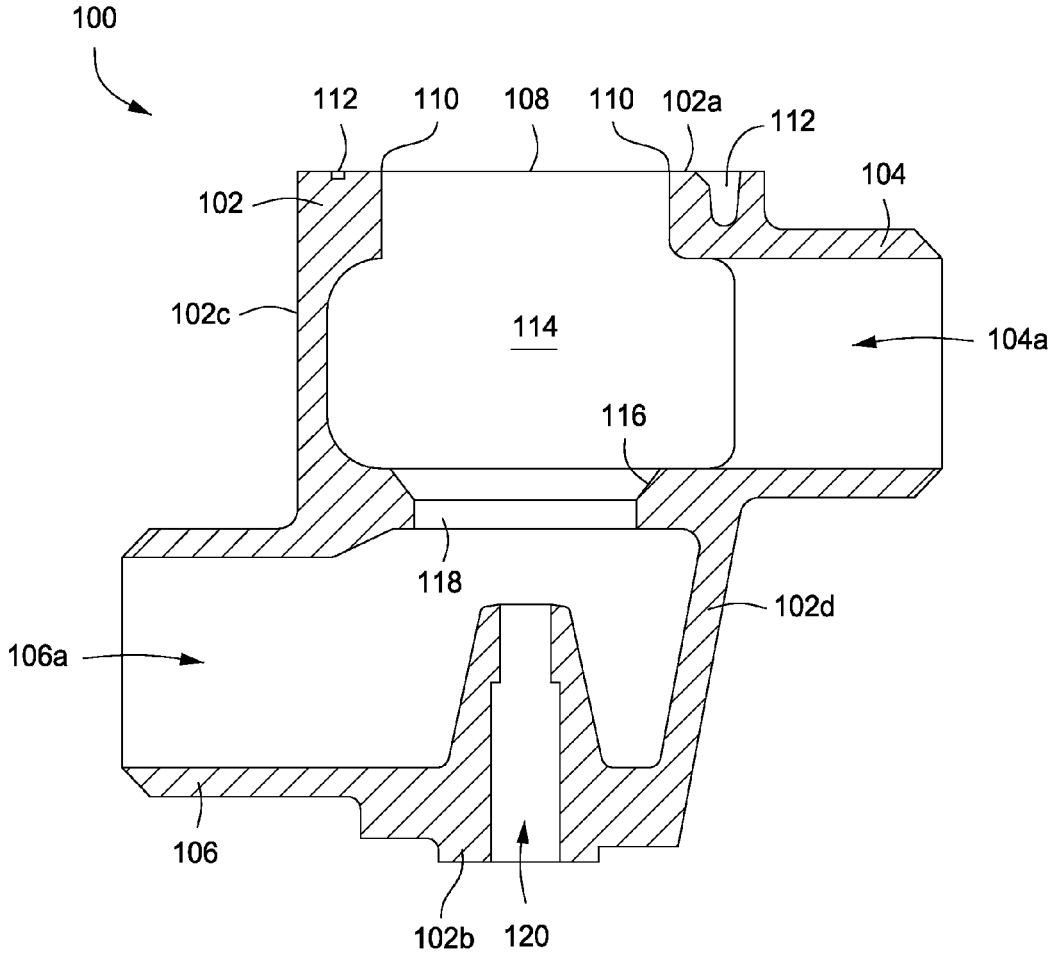
FIG. 1 is a cross-sectional view illustrating an embodiment of a valve body.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

Referring now to FIG. 1, a valve body 100 is illustrated. The valve body 100 includes a base 102 having a top surface 102*a*, a bottom surface 102*b*, and a pair of opposing side surfaces 102*c* and 102*d*. An inlet 104 extends from a location on the side surface 102*d* adjacent the top surface 102*a* and defines an inlet passageway 104*a*. An outlet 106 extends from a location on the side surface 102*c* adjacent the bottom surface 102*b* and defines an outlet passageway 106*a*. An opening 108 is defined by an opening edge 110 on the base 102 and extends into the base 102 from the top surface 102*a*. In an embodiment, the opening 108 is circular in shape. A plurality of cover couplings 112 are located on the top surface 102*a* adjacent the opening 108. A valve stem housing 114 is defined by the base 102 and is located adjacent the opening 108 and the inlet passageway 104*a*. A valve face 116 is located adjacent the valve stem housing 114. In an embodiment, the valve face 116 is circular in shape. In an embodiment, the valve face 116 includes a beveled edge on an internal surface of the valve body 100, as illustrated in FIG. 1. A valve stem opening 118 is defined by the base and located adjacent the valve face 116 and the outlet passageway 106*a*. A valve stem passageway 120 is defined by the base 102, located adjacent the valve stem opening 118, and extends to the bottom surface 102*b* of the base 102. While a specific valve body 100 has been described above, one of skill in the art will recognize that a variety of valve bodies having different features may be substituted with the valve body 100 without departing from the scope of the present disclosure.

Figure 2A:
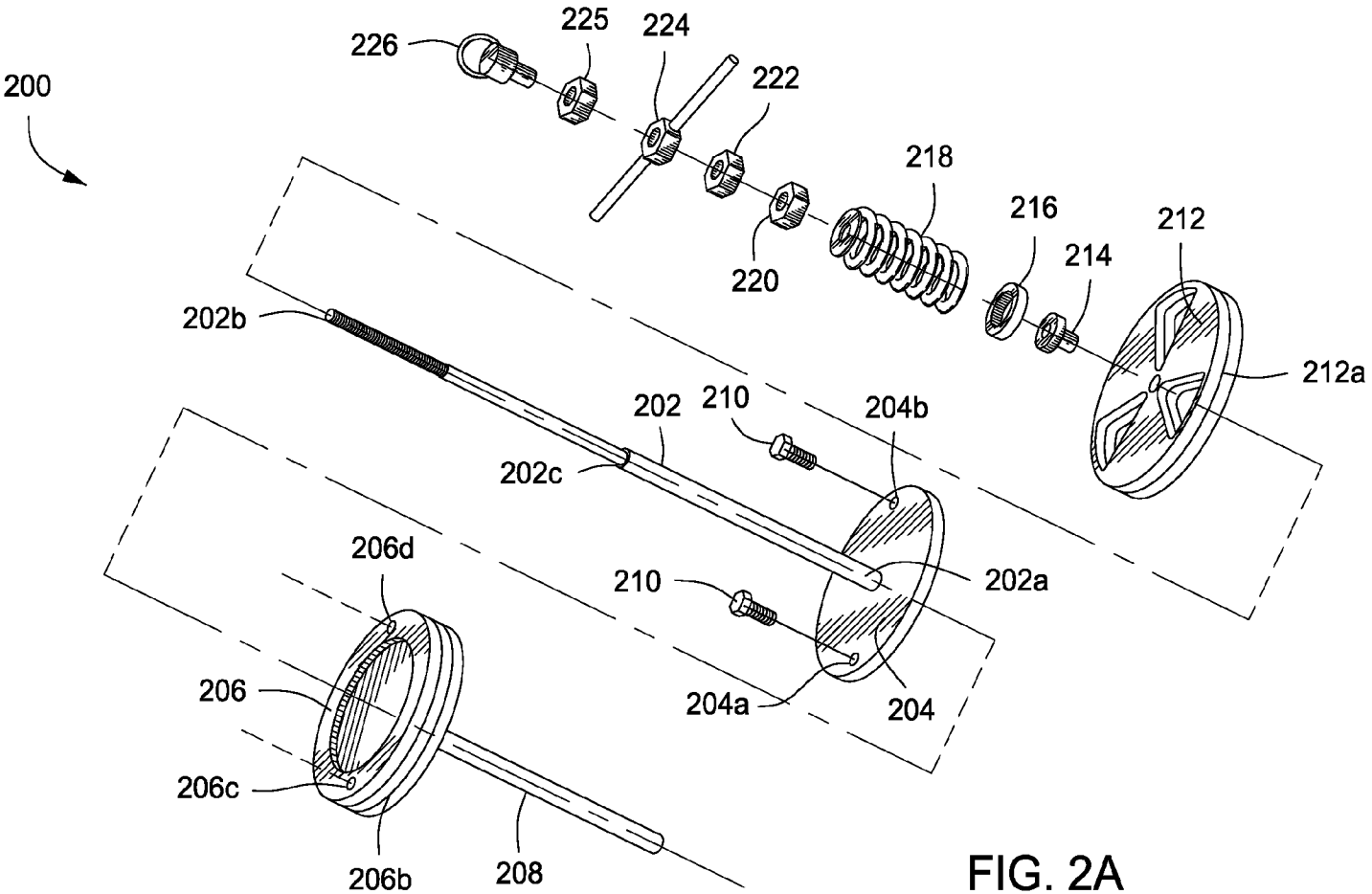
FIG. 2*a* is an exploded view illustrating an embodiment of a lapping system.
Figure 2B:
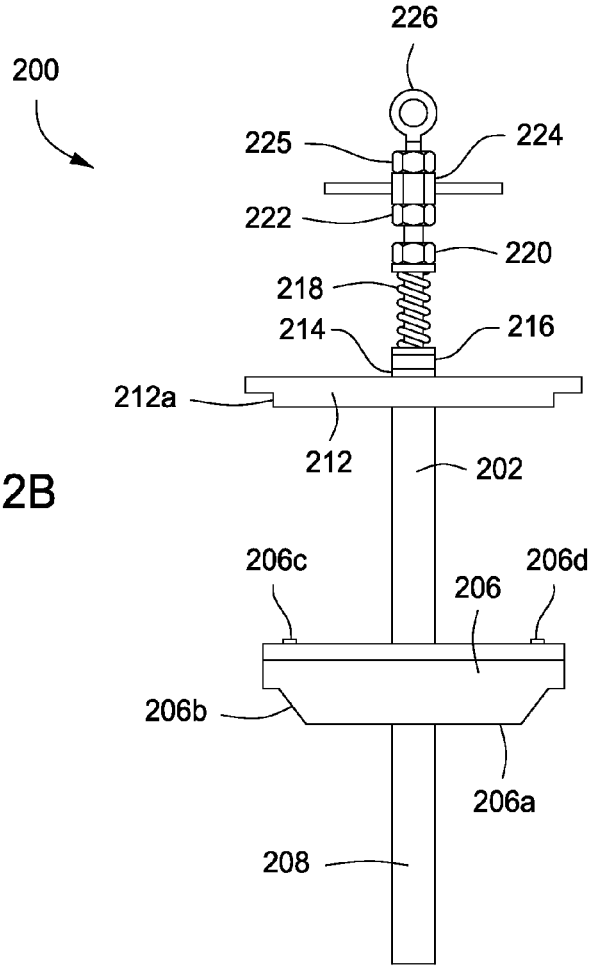
FIG. 2*b* is a front view illustrating an embodiment of the lapping system of FIG. 2*a*.

Referring now to FIGS. 2*a* and 2*b*, a lapping system 200 is illustrated. The lapping system 200 includes a shaft 202 having a first end 202*a* that is coupled to a lapping tool plate 204, a second distal end 202*b* located opposite the shaft 202 from the first end 202*a*, and a circumferential ledge 202*c* that runs about the circumference of the shaft 202 and is located approximately midway between the first end 202*a* and the second distal end 202*b*. A portion of the shaft 202 adjacent the second distal end 202*b* may be threaded, as illustrated. In the illustrated embodiment, the lapping tool plate 204 is generally circular and defines a plurality of securing apertures 204*a* and 204*b* that extend through the lapping tool plate 204. A lapping tool 206 is coupled to the lapping tool plate 204 and includes a stabilizing bar 208 extending from a surface 206*a* of the lapping tool 206 that is opposite the lapping tool plate 204. The lapping tool 206 includes a beveled edge 206*b* adjacent the surface 206*a* and defines a plurality of securing apertures 206*c* and 206*d*. The lapping tool plate 204 is coupled to the lapping tool 206 using a plurality of securing members 210 (e.g., screws) that are positioned in the securing apertures 204*a*, 204*b*, 206*c* and 206*d*. A stabilizing member 212 is located on the shaft 202 adjacent the circumferential ledge 202*c*. The stabilizing member 212 is circular in shape and defines a stabilizing channel 212*a* that is located about the circumference of the stabilizing member 212. In an embodiment, the stabilizing member 212, the lapping tool 204, and the shaft 202 each comprise circular cross sections and share an axis of rotation when coupled together as illustrated in FIG. 2*b*. A guide bushing 214 is located on the shaft 202 immediately adjacent the stabilizing member 212. A thrust bushing 216 is located on the shaft 202 immediately adjacent the guide bushing 214. A spring 218 is located on the shaft 202 immediately adjacent the thrust bushing 216. A pressure adjusting nut 220 is located on the shaft 202 immediately adjacent the spring 218. In an embodiment, the spring 218 and the pressure adjusting nut 220 provide an adjustable force device. However, one of skill in the art will recognize a variety of adjustable force devices that may replace the spring 218 and the pressure adjusting nut 220 without departing from the scope of the present disclosure. A jam nut 222 is located on the shaft 202 adjacent the pressure adjusting nut 220. A handle 224 is located on the shaft 202 immediately adjacent the jam nut 222. A jam nut 225 is located on the shaft 202 immediately adjacent the handle 224 and opposite the jam nut 222. In an embodiment, the pressure adjusting nut 220, the jam nut 222, the handle 224, and the jam nut 225 may be threaded onto the shaft 202. In an embodiment, the shaft 202 is operable to move relative to the stabilizing member 212, the guide bushing 214, the thrust bushing 216, and the spring 218 by, for example, sliding through apertures defined by the components. A lifting member 226 is coupled to the second distal end 202*b* of the shaft 202 and located immediately adjacent the jam nut 225.

Figure 3A:
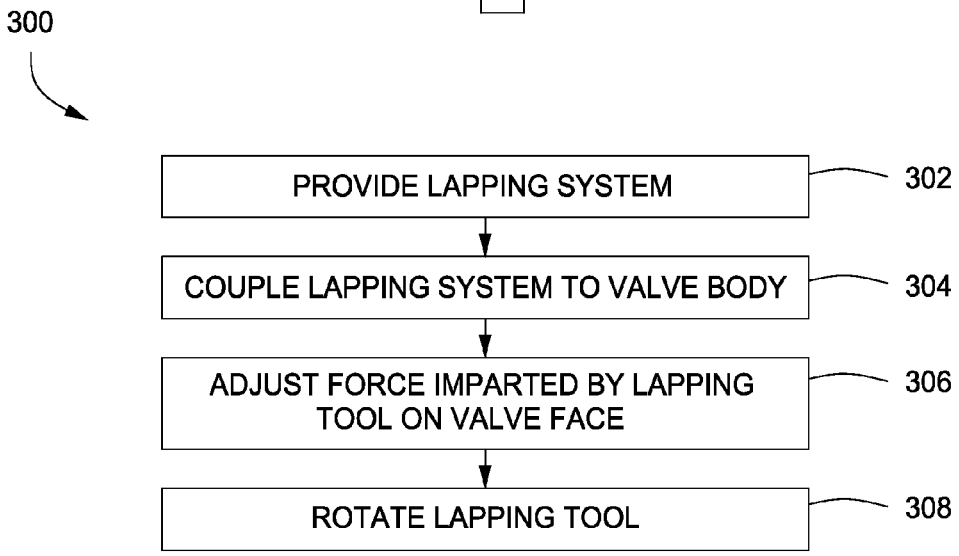
FIG. 3*a* is a flow chart illustrating an embodiment of a method for lapping a valve face.
Figure 3B:
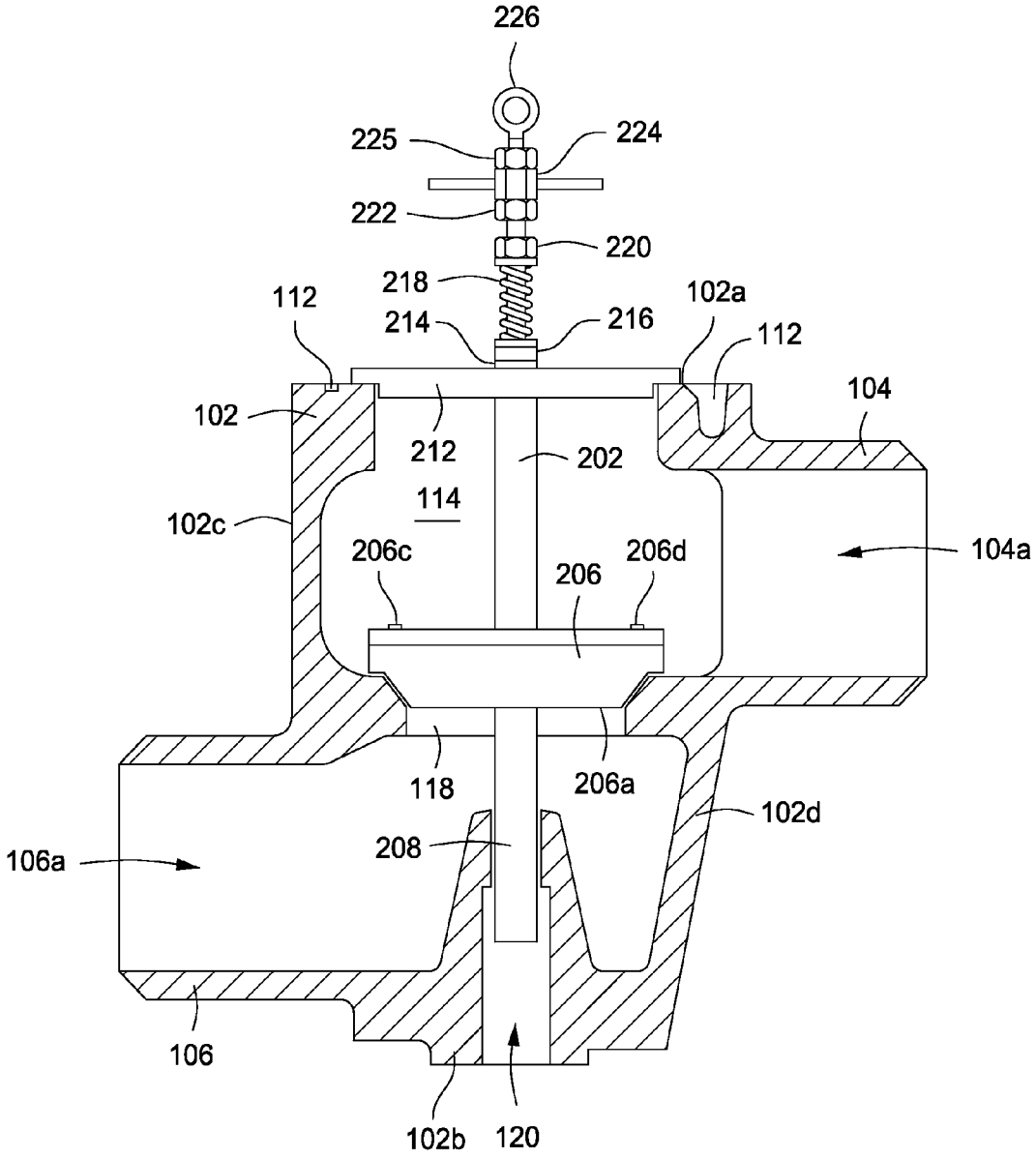
FIG. 3*b* is a partial cross-sectional view illustrating an embodiment of the lapping system of FIGS. 2*a* and 2*b* located in the valve body of FIG. 1.
Figure 3C:
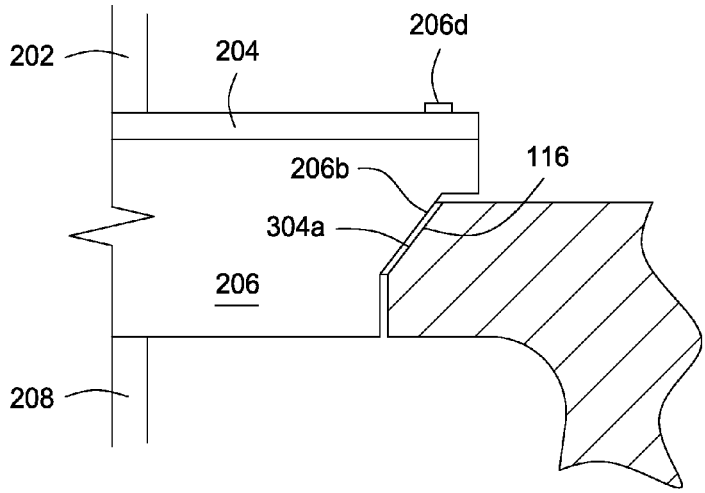
FIG. 3*c* is a partial cross-sectional view illustrating an embodiment of a lapping tool of the lapping system of FIGS. 2*a* and 2*b* and a valve face of the valve body of FIG. 1 with an abrasive material between them.

Referring now to FIGS. 1, 2*b*, 3*a*, 3*b*, 3*c* and 3*d*, a method 300 for lapping a valve face is illustrated. The method 300 begins at block 302 where a lapping system is provided. In an embodiment, the lapping system 200, described above with reference to FIGS. 2*a* and 2*b*, is provided. The method 300 then proceeds to block 304 where the lapping system is coupled to a valve body. The lapping system 200 is positioned adjacent the valve body 100, described above with reference to FIG. 1, such that the stabilizing bar 208 is located adjacent the opening 108 defined adjacent the top surface 102*a* of the valve body 100. The lapping system 200 is then moved towards the valve body 100. Movement of the lapping system 200 towards the valve body 100 causes the stabilizing bar 208 and the lapping tool 206 to enter the valve stem housing 114. The stabilizing bar 208 and the lapping tool 206 then move through the valve stem housing 114 until the stabilizing bar 208 enters the valve stem passageway 120 and the beveled surface 206*b* on the lapping tool 206 engages the valve face 116 (illustrated in FIG. 1). With the lapping tool engaging the valve face 116, the stabilizing member 212 engages the valve body 100 such that the opening edge 110 (illustrated in FIG. 1) on the valve body 100 becomes located in the stabilizing channel 212*a* (illustrated in FIG. 2*b*) and the stabilizing member 212 becomes seated in the opening 108, as illustrated in FIG. 3*b*. By positioning the stabilizing bar 208 in the valve stem passageway 120 and seating the stabilizing member 212 in the opening 108 on the valve body 100 (as a result of positioning the opening edge 110 in the stabilizing channel 212*a*), the lapping tool 200 is aligned with the valve face 116 to help ensure that symmetrical and even lapping operations may be conducted on the valve face 116 with the lapping tool 206. In an embodiment, an abrasive material 304*a* such as, for example, Clover® brand lapping compounds and/or a variety of other lapping compounds known in the art, is provided between the beveled surface 206*b* on the lapping tool 206 and the valve face 116, as illustrated in FIG. 3*c*.

The method 300 then proceeds to block 306 where the force imparted by the lapping tool on the valve face is adjusted. With the lapping system 200 coupled to the valve body 100 as illustrated in FIG. 3*b*, the weight of some or all of the components of the lapping system provides a force on the valve face 116 through the lapping tool 206. However, due to the coupling of the lapping tool 206 to the shaft 202, the coupling of the stabilizing member 212 to the shaft 202 and the opening edge 110 on the valve body 100, and the coupling of the adjustable force device (i.e., the spring 218 and the pressure adjusting nut 220) to the stabilizing member 212 and the shaft 202, the pressure adjusting nut 220 may be adjusted to compress or decompress the spring 218 in order to adjust the force imparted by the lapping tool 206 on the valve face 116. For example, if the force imparted by the lapping tool 206 on the valve face 116 is too great, the pressure adjusting nut 220 may be adjusted (i.e., rotated) to compress the spring 218, which causes the spring 218 to exert a force on shaft 202 through the pressure adjusting nut 220. The force exerted on the shaft 202 is opposite the force provided by the weight of the components of the lapping system 200, and causes at least some of the weight of the components of the lapping system 200 (e.g., the lapping tool 206, the stabilizing bar 208, etc.) to be transferred through the stabilizing member 212 to the opening edge 110 on the valve body 100 rather than through the lapping tool 206 to the valve face 116. If the force imparted by the lapping tool 206 on the valve face 116 is too little, the pressure adjusting nut 220 may be adjusted (i.e., rotated) to decompress the spring 218, which will allow less of the weight of the components of the lapping system 200 (e.g., the lapping tool 206, the stabilizing bar 208, etc.) to be transferred through the stabilizing member 212 to the opening edge 110 on the valve body 100 and instead allow that weight to be transferred from the lapping tool 206 to the valve face 116. Thus, the force imparted by the lapping tool 206 on the valve face 116 may be precisely controlled in order optimize lapping operations.

Figure 3D:
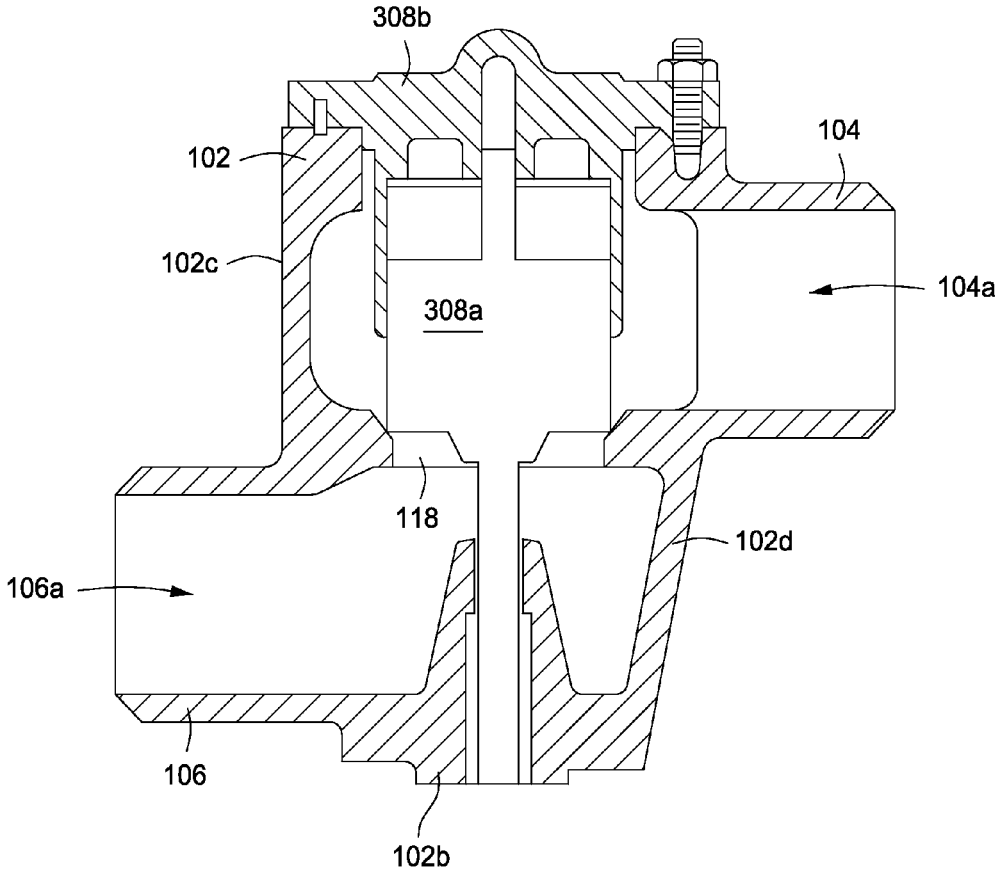
FIG. 3*d* is a partial cross-sectional view illustrating an embodiment of a valve stem located in the valve body of FIG. 1.

The method 300 then proceeds to block 308 where the lapping tool is rotated. With the lapping system 200 coupled to the valve body 100 as illustrated in FIG. 3*b*, the handle 224 may be turned in order to rotate the shaft 202. Rotation of the shaft 202 causes the lapping tool 206 to rotate relative to the valve face 116 such that the abrasive material 304*a* located between the beveled surface 206*b* on the lapping tool 206 and the valve face 116 abrades/polishes the valve face 116. While the handle 224 is being turned, horizontal forces (i.e., forces in a direction that is radial to the longitudinal axis of the shaft 202) applied to the handle 224 are prevented from being transferred to the lapping tool 206 by the stabilizing member 212. Such horizontal forces can cause the lapping tool 206 to 'orbit' and create an uneven surface on the valve face 116. However, the stabilizing member 212 ensures that only a vertical force is imparted by the lapping tool 206 to the valve face 116. When lapping operations are complete and the valve face 116 has been polished to a desired level, the lapping tool 200 may be removed from the valve stem housing 114, a valve stem 308*a* may be positioned in the valve stem housing 114, and a cover 308*b* may be coupled to the valve stem 308*a* and the valve body 100, as illustrated in FIG. 3*d*. By using the lapping system 200 as described above, the valve face 116 may be lapped evenly and completely in order to provide a tight seal between the valve stem 308*a* and the valve face 116. Thus, a lapping system is provided that ensures alignment of a lapping tool with the valve face while providing a controlled, vertical force from the lapping tool to the valve face.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A lapping system, comprising:

a shaft;

a stabilizing member coupled to the shaft and configured to be in contact with a valve body;

a lapping tool coupled to the shaft and spaced apart on the shaft from the stabilizing member; and an adjustable force device coupled to the shaft, the stabilizing member, and the lapping tool, wherein the adjustable force device is configured such that compressing the adjustable force device transfers at least some of the weight of the lapping tool away from a valve face of the valve body and decompressing the adjustable force device transfers at least some of the weight of the lapping tool to the valve face of the valve body.

2. The system of claim 1, further comprising:

a handle coupled to the shaft and operable to rotate the shaft about a shaft axis.

3. The system of claim 1, wherein a stabilizing bar extends from the lapping tool.

4. The system of claim 1, wherein the lapping tool comprises a beveled edge.

5. The system of claim 1, wherein the stabilizing member, the lapping tool, and the shaft each comprise circular cross sections and share an axis of rotation.

6. The system of claim 1, wherein a stabilizing channel is defined about an outer edge of the stabilizing member.

7. The system of claim 1, wherein the adjustable force device comprises a spring.

8. A valve face lapping system, comprising:

a valve body comprising a valve face and defining an opening; and a lapping system coupled to the valve body, the lapping system comprising:

a shaft;

a stabilizing member coupled to the shaft and seated in the opening;

a lapping tool coupled to the shaft and spaced apart on the shaft from the stabilizing member, wherein the lapping tool is located immediately adjacent the valve face; and an adjustable force device coupled to the shaft, the stabilizing member, and the lapping tool, wherein the adjustable force device is configured such that compressing the adjustable force device transfers at least some of the weight of the lapping tool away from a valve face of the valve body and decompressing the adjustable force device transfers at least some of the weight of the lapping tool to the valve face of the valve body.

9. The system of claim 8, further comprising:

a handle coupled to the shaft and operable to rotate the shaft about a shaft axis.

10. The system of claim 8, wherein a stabilizing bar extends from the lapping tool.

11. The system of claim 10, further comprising:

a passageway defined by the valve body, wherein the stabilizing bar is located in the passageway.

12. The system of claim 8, wherein the lapping tool comprises a beveled edge.

13. The system of claim 12, wherein an abrasive material is located between the beveled edge and the valve face.

14. The system of claim 8, wherein the stabilizing member, the lapping tool, and the shaft each comprise circular cross sections and share an axis of rotation.

15. The system of claim 8, wherein a stabilizing channel is defined about an outer edge of the stabilizing member, and wherein at least a portion of the valve body immediately adjacent to the opening is located in the stabilizing channel.

16. The system of claim 8, wherein the adjustable force device comprises a spring.

17. A method for lapping a valve face, comprising:

providing a lapping system comprising a lapping tool coupled to a stabilizing member through a shaft, and an adjustable force device coupled to the stabilizing member, the shaft, and the lapping tool;

coupling the lapping system to a valve body, wherein the lapping tool is located adjacent a valve face of the valve body and the stabilizing member is seating in an opening defined by the valve body;

adjusting the force imparted by the lapping tool on the valve face using the adjustable force device such that compressing the adjustable force device transfers at least some of the weight of the lapping tool away from the valve face of the valve body and decompressing the adjustable force device transfers at least some of the weight of the lapping tool to the valve face of the valve body; and rotating the shaft to move the lapping tool relative to the valve face.

18. The method of claim 17, further comprising:

providing an abrasive material between the lapping tool and the valve face.

19. The method of claim 17, wherein the rotating the shaft comprises turning a handle that is coupled to the shaft.

* * * * *